US005980308A

United States Patent [19]

Hu et al.

[11] Patent Number: 5,980,308

[45] Date of Patent: Nov. 9, 1999

[54] FEMALE SOCKET OF A CONNECTOR

[76] Inventors: Yu-Tung Hu, 4F1-3. No. 1, Lane 125, Hsi Tsang Rd.; She Ou Yang, 2f1., No. 16, Lane 238, Tun Hua N. Rd., both of Taipei, Taiwan

[21] Appl. No.: 09/078,308

[22] Filed: May 13, 1998

[51] Int. Cl.[6] ..... H01R 9/07

[52] U.S. Cl. ..... 439/497; 439/579

[58] Field of Search ..... 439/497, 579, 439/95, 610, 499

[56] References Cited

U.S. PATENT DOCUMENTS

| | | | |
|---|---|---|---|
| 4,352,531 | 10/1982 | Gutter | 439/497 |
| 4,365,856 | 12/1982 | Yaegashi et al. | 439/497 |
| 4,406,512 | 9/1983 | Schell | 439/497 |

*Primary Examiner*—Paula Bradley
*Assistant Examiner*—Tho D. Ta
*Attorney, Agent, or Firm*—Pro-Techtor International Services

[57] ABSTRACT

A female socket of a connector adapted for connecting to coaxial wires of a flat cable. The female socket mainly includes a socket base, a cover, and a metal shell. The socket base is provided at one front side with a plurality of insertion slots and a plurality of terminal receiving slots corresponding to and communicable with the insertion slots for each receiving an electrical terminal therein. The flat cable is extended into the socket base from another side opposite to the insertion slots with each coaxial wire of the flat cable rested in one terminal receiving slot to contact with an inner arm portion of the terminal. The cover is closed to a top of the socket base to tightly press the coaxial wires against the terminals. The cover has a top window for receiving a ground pin which contacts with a conductive plate connected to the coaxial wires. The metal shell encloses the socket base and the cover and contacts with the ground pin to allow the conductive plate of the coaxial wires to externally grounded. The terminals have outer pin insertion holes for receiving pins on a male plug connected to the female socket.

9 Claims, 6 Drawing Sheets

FEMALE SOCKET OF A CONNECTOR

BACKGROUND OF THE INVENTION

The present invention relates to improvements made to a female socket of a connector, so that the female socket can be more easily assembled and is more effective in use.

A connector consists of a male plug and a female socket engaged with one another. The male plug includes insertion pins which are inserted into insertion slots included in the female socket to achieve an electric connection.

Either the male plug or the female socket is designed to achieve connection between wires (electric wires) and electrical terminals. A conventional wire adopted in a connector in early stage is a single-core wire via which signals are transmitted at low speed and tend to be interfered by noise. To overcome such problems, a kind of coaxial wire has been developed. To make electronic products even more compact than before and to make the wiring in the products neat and orderly, a plurality of coaxial wires are combined to form a flat cable. Presently, most precision electronic and computer products all use such flat cable.

FIG. 1 is a plan view showing a flat cable A which includes a plurality of coaxial wires 1 parallelly arranged side by side to form a flat band. Each coaxial wire 1 includes, from inner side to outer side, a core 11, a core insulation 12 wrapping around the core 11, a braided wire 13 coaxial with the core 11, and an insulating skin 14. A part of the insulating skin 14 near an end portion of each coaxial wire 1 is peeled to allow a conductive plate 15 to transversely connect to the braided wire 13. The core insulation 12 at the same end portion of each coaxial wire 1 is then peeled to bare the core 11. Glue material 16 is applied at outer ends of the bare cores 11 to fix the distance between every two adjacent bare cores 11.

FIG. 2 is a sectional view of a conventional female socket B of a connector. From FIG. 2, the manner in which the above-described flat cable A is connected to the conventional female socket B can be seen. The female socket B of a connector includes a base board 2, a socket seat 3, and a transfer plate 4. The base board 2 is formed of a plurality of terminal receiving slots 21 to each receive an electrical terminal 22 therein. An upward-open sliding groove 23 is formed on top of the base board 2 for a sliding member 25 to sideward slide thereinto. The end portion of each coaxial wire 1 of the flat cable A is rested on one terminal receiving slot 21 of the base board 2, so that each bare core 11 at the end portion of the coaxial wire 1 is located above an inner end 22*a* of the electrical terminal 22 received in that terminal receiving slot 21. A pressing bar 24 is positioned on top of the bare cores 11 and is pushed downward by the sliding member 25 to tightly and firmly press the bare cores 11 against the inner ends 22*a* of the terminals 22. Downward projected portions 26 are provided at a bottom of the base board 2 to engage into recesses 41 correspondingly provided on a top of the transfer plate 4. The socket seat 3 is provided with a plurality of insertion slots 31. In each of the insertion slots 31, there are metal legs 32 extending to outside of the insertion slots 31. An outer end 32*a* of each metal leg 32 is indirectly connected to an outer end 22*b* of a corresponding electrical terminal 22 via a line 42 provided on the transfer plate 4 to extend between the metal leg 32 and the terminal 22. Tenons 33 are provided at a bottom of the socket seat 3 to engage with mortises 43 correspondingly formed on the transfer plate 4. Each of the insertion slots 31 on the socket seat 3 receives a pin (not shown) on a male plug (not shown) of the connector when the male plug is plugged into the female socket B.

The above-described conventional female socket B is not easy to assemble and has a large volume. Moreover, the conductive plate 15 contacting with the coaxial wires 1 is not substantively and externally grounded and therefore, noise can not be effectively eliminated during signal transmission.

SUMMARY OF THE INVENTION

A primary object of the present invention is to provide a female socket of a connector that can be easily assembled and occupies small volume while provides good effectiveness in use.

The female socket according to the present invention includes a socket base, a cover, and a metal shell. The socket base is provided at one side with a plurality of insertion slots communicating with corresponding terminal receiving slots for each receiving a terminal therein. A flat cable is connected to the female socket from another side opposite to the insertion slots with coaxial wires in the flat cable separately locating in the terminal receiving slots and contacting with inner arm portions of the terminals. The cover is closed to a top of the socket base to press the coaxial wires against the terminal. The cover is provided with a top window for receiving a ground pin which contacts with a conductive plate connected to the coaxial wires of the flat cable. The metal shell encloses the socket base and the cover and contacts with the ground pin, so that the conductive plate of the flat cable is externally grounded via the ground pin and the metal shell. A male plug may be connected to the female socket by plugging pins into outer pin insertion holes of the terminals received in the terminal receiving slots of the female socket.

In another embodiment of the present invention, the metal shell is provided at an end wall with an insertion opening. An insert with a central through hole is set in the insertion opening. Bodies of the coaxial wires pass the through hole of the insert with the glued end portion of the coaxial wires rested on the terminal receiving slots of the socket base, so that the coaxial wires may extend out of the female socket in a bent manner.

BRIEF DESCRIPTION OF THE DRAWINGS

The structure, the features, and the function of the present invention can be best understood by referring to the following detailed description of the preferred embodiments and the accompanying drawings, wherein.

DETAILED DESCRIPTION OF THE PREFERRED EMBODIMENTS

Figure 1:
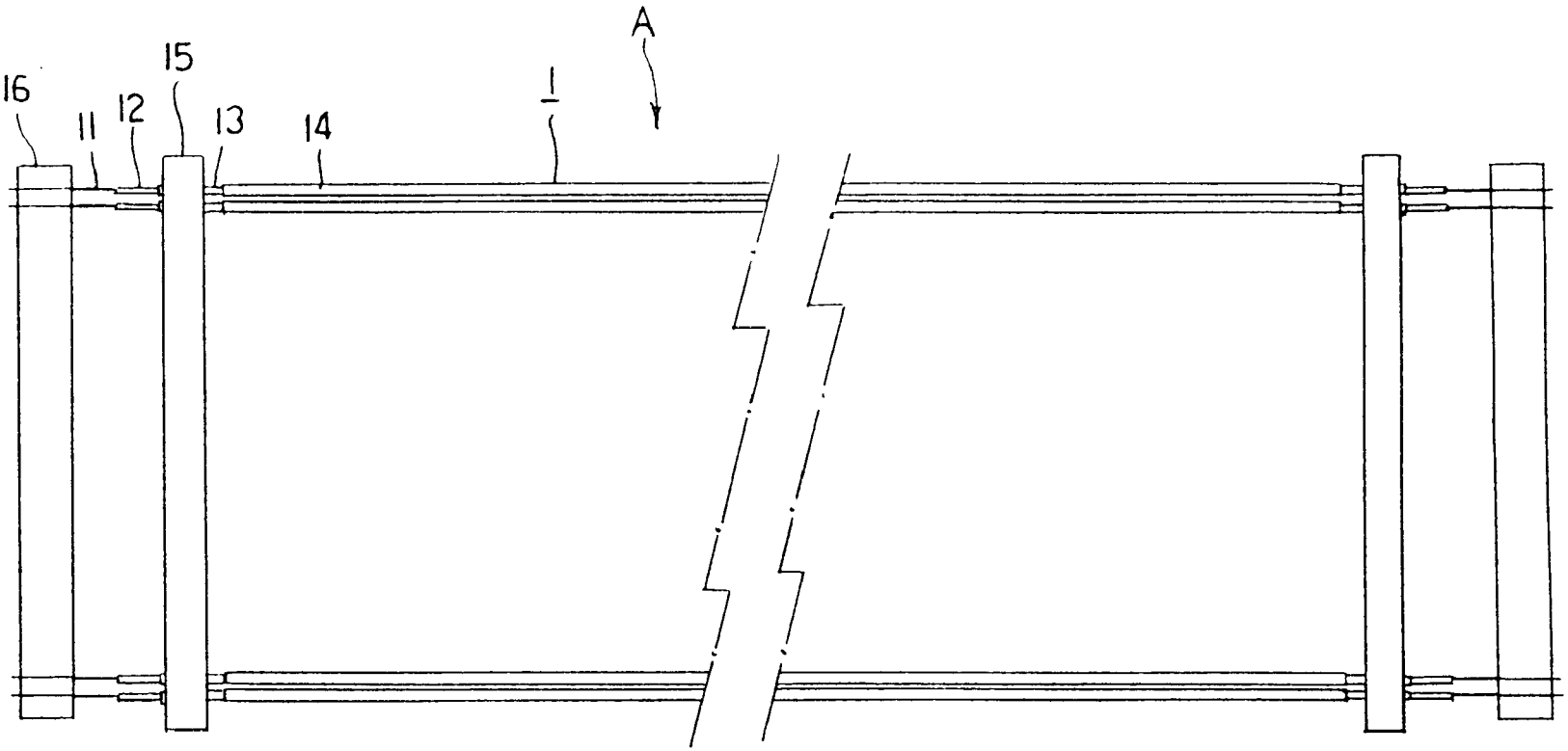
FIG. 1 is a schematic plan view of a flat cable consisting of parallelly arranged coaxial wires.
Figure 2:
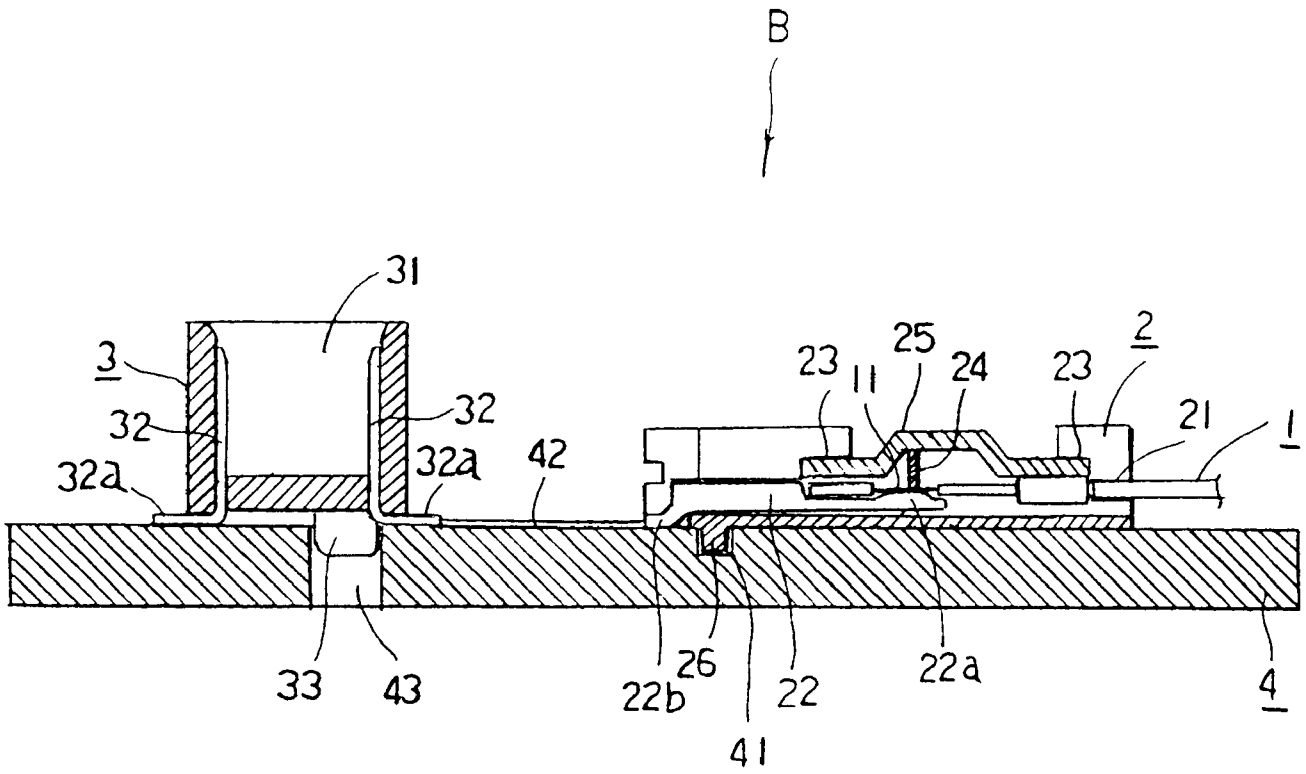
FIG. 2 (Prior Art)
FIG. 2 is a side sectional view of a conventional female socket of a connector.
Figure 3:
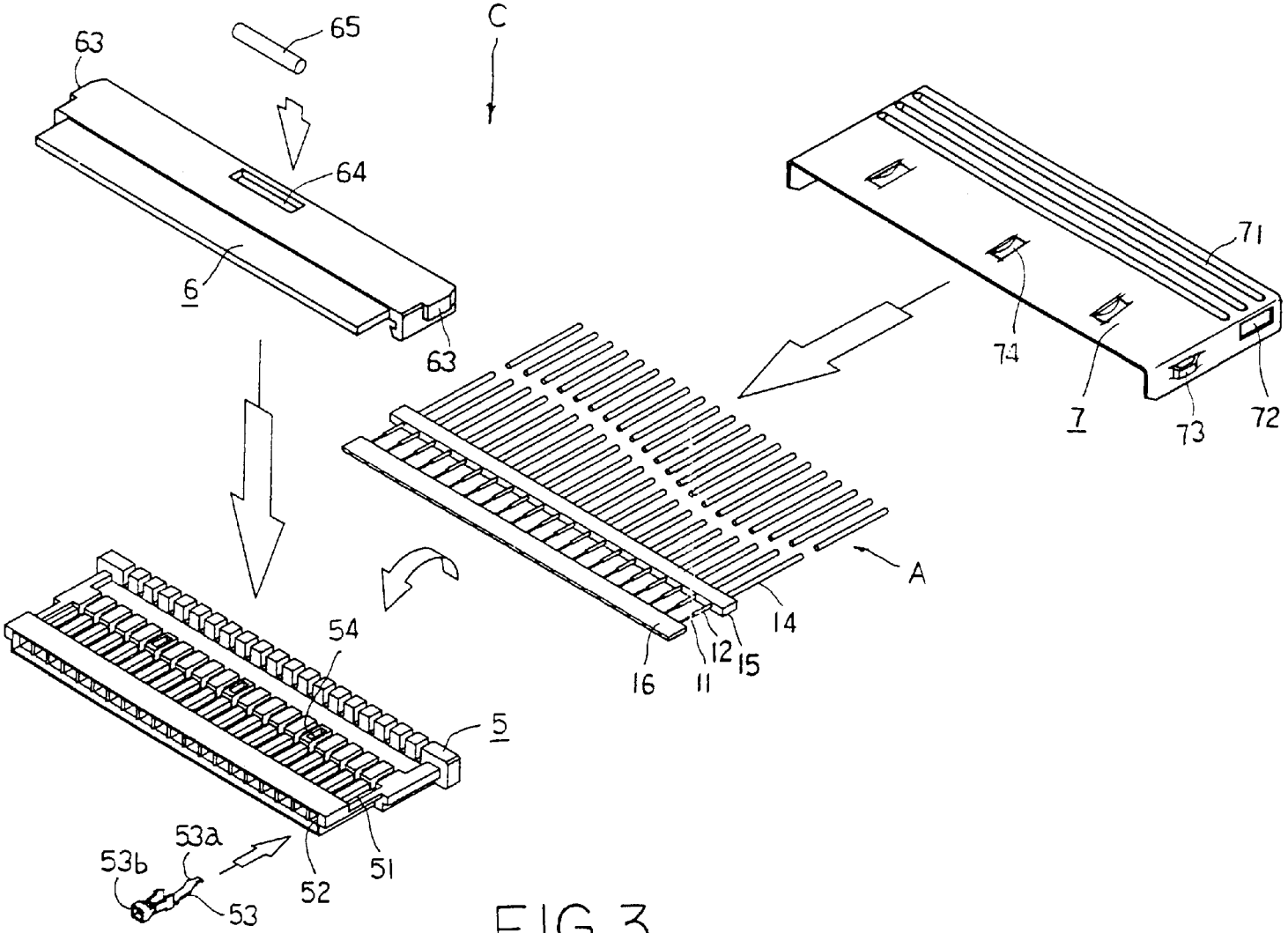
FIG. 3 is an exploded perspective of a female socket according to a first embodiment of the present invention.
Figure 4:
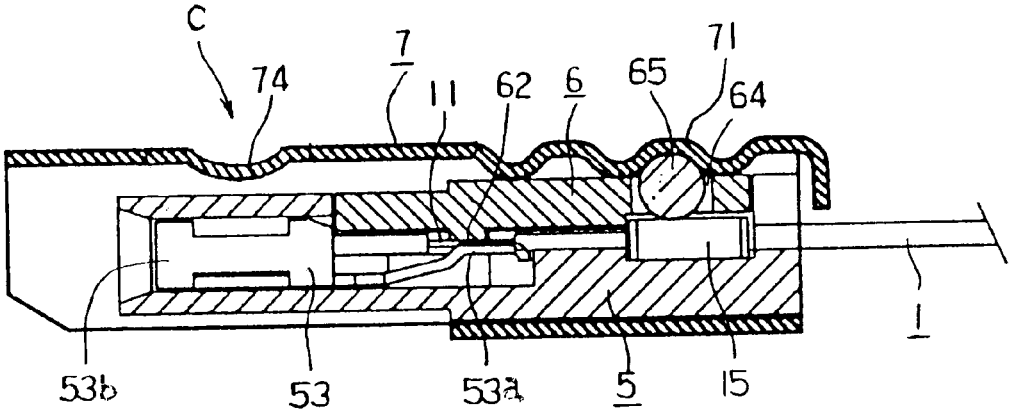
FIG. 4 is an assembled side sectional view of the female socket of FIG. 3.
Figure 5:
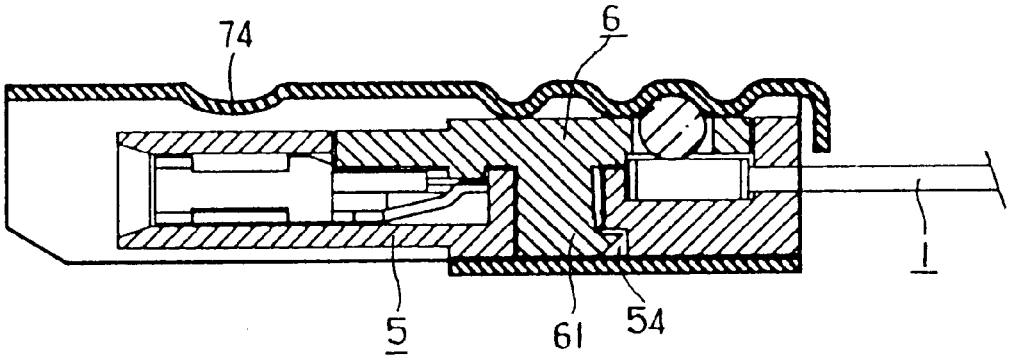
FIG. 5 is another assembled side sectional view of the female socket of FIG. 3 taken on a position at where a cover of the female socket is engaged with a base of the female socket.

Please refer to FIGS. 3, 4 and 5. The present invention relates to a female socket C of a connector adapted for connecting to a flat cable A consisting of coaxial wires 1.

The female socket C mainly includes a socket base 5, a cover 6, and a metal shell 7.

The socket base 5 is provided at one side with a plurality of insertion slots 52 communicating with a plurality of corresponding terminal receiving slots 51. Electrical terminals 53 each including an inner arm portion 53*a* and an outer pin insertion hole 53*b* are inserted forward into the insertion slots 52 with the inner arm portions 53*a* extended into the terminal receiving slots 51. At least one vertically extended retaining through hole 54 is provided on the socket base 5 at predetermined position.

The cover 6 is provided at inner surface of a top wall with at least one hook portion 61. The number and position of the hook portion 61 correspond to that of the retaining hole 54 on the socket base 5, so that the at least one hook portion 61 extends into and are retained in the at least one retaining hole 54 when the cover 6 is closed to a top of the socket base 5, as shown in FIG. 5. The cover 6 is also provided at the top wall inner surface with an inner downward projection 62, as shown in FIG. 4, and at two outer end surfaces with lugs 63, as shown in FIG. 3. A window 64 is formed at the top wall of the cover 6 at a predetermined position for receiving a ground pin 65 therein, as shown in FIGS. 3 and 5.

The metal shell 7 encloses the socket base 5 and the cover 6 and is formed at a top wall with a corrugated portion 71. One corrugation on the corrugated portion 71 is adapted for fitly contacting with the ground pin 65 which partially projects from the window 64, as shown in FIGS. 4 and 5. The metal shell 7 is provided at two end walls with openings 72 for engaging with the lugs 63 on the cover 6. And, two outward projections 73 are formed at the two end walls and at least one inward projection 74 are formed at the top wall of the metal shell 7.

To assemble the female socket C and the flat cable A, first rest the end portions of the coaxial wires 1 of the flat cable A in the terminal receiving slots 51 on the socket base 5, such that bare cores 11 of the coaxial wires 1 just locate on and contact with the inner arm portions 53*a* of the terminals 53 that have been inserted into the insertion slots 52. Then, close the cover 6 over the socket base 5 with the at least one hook portion 61 extending into the at least one retaining through hole 54 and being retained in the at least one retaining hole 54. At this point, the inner downward projection 62 of the cover 6 presses against the bare cores 11 of the coaxial wires 1, so that the bare cores 11 closely contact with the inner arm portions 53*a* of the terminals 53 below them. Meanwhile, the ground pin 65 positioned in the window 64 of the cover 6 contacts with the conductive plate 15 connected to the end portion of the coaxial wires 1. Finally, enclose the socket base 5 and the cover 6 with the metal shell 7 with the lugs 63 at two ends of the cover 6 engaging into the openings 72 at two end walls of the metal shell 7 to hold the socket base 5 and the cover 6 in the metal shell 7.

When a male plug (not shown) is plugged into the female socket C, the outward projections 73 and the at least one inward projection 74 on the metal shell 7 will contact with metal supporting members and metal shell, respectively, of the male plug. And, the conductive plate 15 connected to the coaxial wires 1 is externally grounded via the ground pin 65 and the metal shell 7.

In the above-described first embodiment of the female socket of a connector, the flat cable A connected at one end to the female socket extends out of the female socket in a direction the same as the direction in which the insertion and the terminal receiving slots extend. That is, the coaxial wires 1 of the flat cable A extend out of the female socket in a linear manner. Sometimes, due to limitations and/or actual needs in the design and assembling of the female socket, the coaxial wires 1 of the flat cable A must extend out of the female socket in a direction normal to the extending direction of the terminal receiving slots on the female socket. That is, the coaxial wires 1 extend out of the female socket in a bent manner. To prevent the coaxial wires 1 from being damaged and to maintain the coaxial wires in orderliness when they go out of the female socket in a bent manner, the present invention provides a second embodiment of the female socket of a connector that is particularly designed for bent-outgoing coaxial wires 1.

Figure 6:
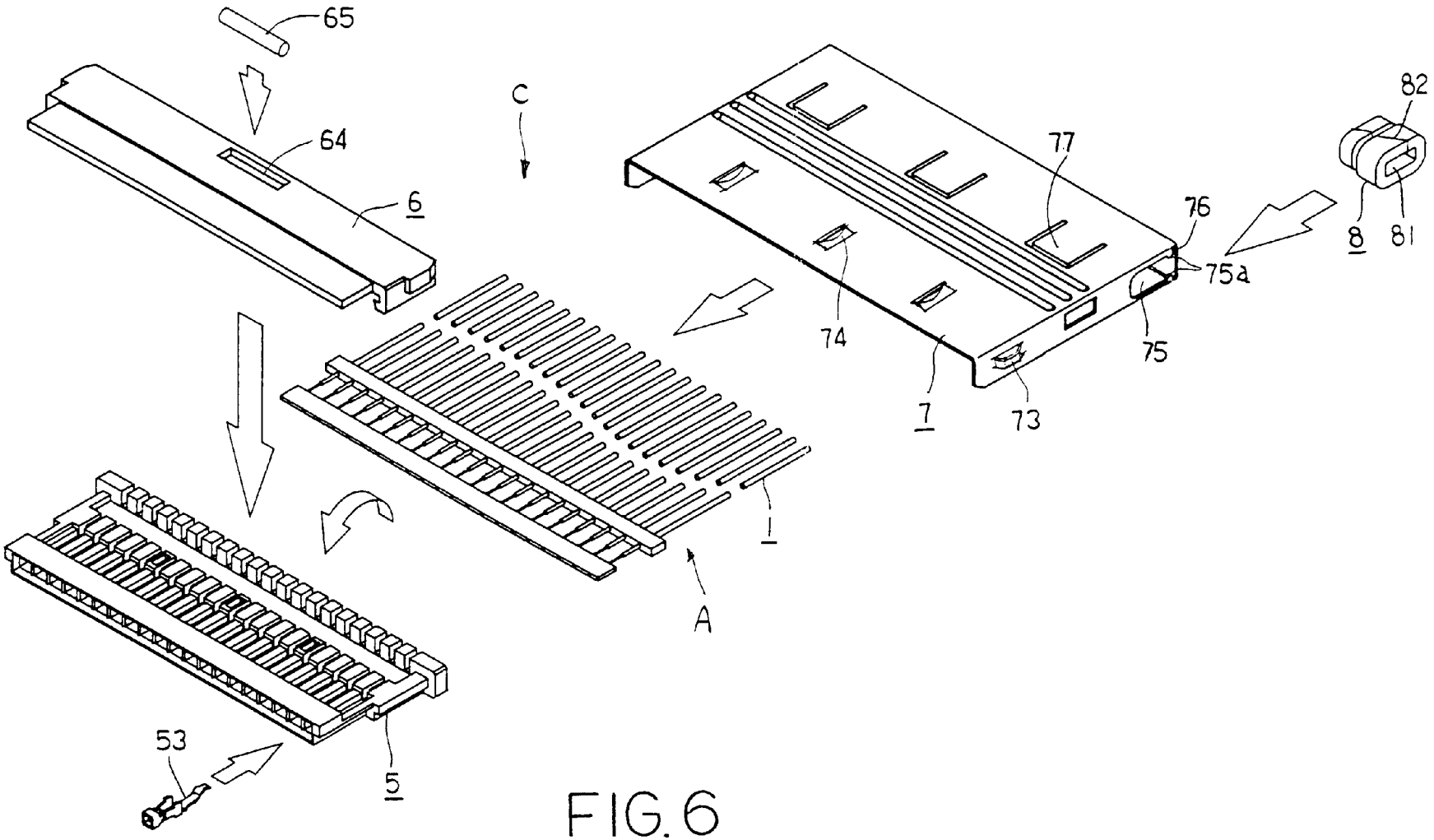
FIG. 6 is an exploded perspective of another female socket according to a second embodiment of the present invention.
Figure 7:
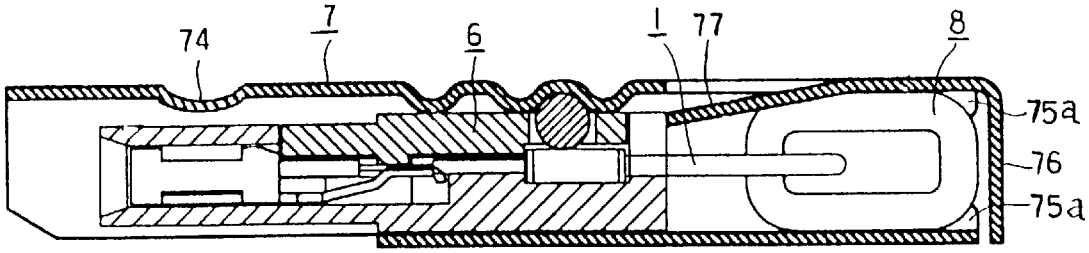
FIG. 7 is an assembled side sectional view of the female socket of FIG. 6.
Figure 8:
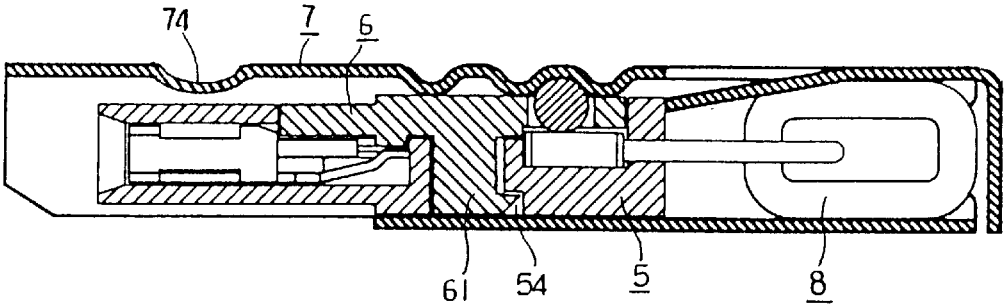
FIG. 8 is another assembled side sectional view of the female socket of FIG. 6 taken on a position at where a cover of the female socket is engaged with a base of the female socket.

FIGS. 6, 7 and 8 illustrate this second embodiment of the present invention. In the drawings, like elements will be denoted by the same reference numerals. In this embodiment, the female socket C includes a socket base 5 and a cover 6 the same as that in the first embodiment, and the flat cable A is connected to the female socket C in the same manner as that in the first embodiment. However, a metal shell 7 included in this second embodiment is provided at one end wall with a backward-facing insertion opening 75 for receiving an elastic insert 8 therein. Stoppers 75*a* are provided at upper and lower edges of an open end of the insertion opening 75 to prevent the insert 8 from falling out of the insertion opening 75. The insert 8 has a central through hole 81 and a top cut 82. Due to an elasticity of the insert 8, the top cut 82 can be pulled open to lay portions of the coaxial wires 1 outside the socket base 5 in the through hole 81 of the insert 8 before the insert 8 is sideward inserted into the insertion opening 75. After the insert 8 is located in the opening 75, a previously lifted back piece 76 of the metal shell 7 is downward bent to shield the backward open end of the opening 75 and to cooperate with the stoppers 75*a* to prevent the insert 8 from falling out of the metal shell 7. With the insert 8, the coaxial wires 1 of the flat cable A may extend out of the female socket C in a bent and orderly manner without being damaged. In the second embodiment, the metal shell 7 is further provided near a rear portion of a top wall with forward extended and downward inclined stopping plates 77. Front ends of the stopping plates 77 abut against a rear wall of the socket base 5 to keep the socket base 5 in place in the metal shell 7, lest the socket base 5 should become loose in the metal shell 7 when a male plug is plugged in or removed from the female socket C.

What is claimed is:

1. A female socket of a connector adapted for connecting to a flat cable, said flat cable consisting of a plurality of coaxial wires parallelly arranged side by side and each of said coaxial wires consisting of, from inside to outside, a core, a core insulation wrapping said core, a braided wire wrapping said core insulation and coaxial with said core, and an outer insulating skin, said insulating skin near an end portion of said coaxial wires for extending into said female socket being peeled to expose said braided wires for a conductive plate to connect thereto, said core insulation at an outer end of the same end portion of each said coaxial wire being peeled to bare said core, and said bare cores being coated with glue to fix distances between every two adjacent bare cores; said female socket of a connector comprising:

a socket base provided at a front side thereof with a plurality of insertion slots communicating with a plurality of corresponding terminal receiving slots for each receiving an electrical terminal, said electrical terminal each including an inner arm portion rested in one said terminal receiving slot and an outer pin-insertion hole located in one said insertion slot, at least one retaining hole being provided on said socket base at predetermined position, and said end portion of said coaxial wires being extended into said female socket from another side of said female socket opposite to said front side, such that each of said coaxial wires of said flat cable is rested in one of said terminal receiving slots to contact with said inner arm portion of said electrical terminal rested in the same terminal receiving slot; a cover closed to a top of said socket base, said cover having a top wall with an inner surface, said inner surface having; at least one downward projected hook portion corresponding to and extending into said at least one retaining hole on said socket base to be retained in said retaining hole, said cover also being provided at said inner surface of top wall with a downward extended inner projection which presses said bare cores of said coaxial wires downward to tightly contact with said inner arm portions of said electrical terminals, said cover having two end walls with outward projected lugs and said cover being provided; at said top wall thereof with a window, a ground pin being positioned in said top window to contact a said conductive plate connected to said coaxial wires in said terminal receiving slots; and a metal shell enclosing said socket base and said cover, said metal shell having a top wall with a corrugated portion, one corrugation of said corrugated portion fittingly contacting with an upper portion of said ground pin in said top window of said cover, and said metal shell also having two end walls with openings to engage with said lugs of said cover.

2. A female socket of a connector as claimed in claim 1, wherein said metal shell is provided at said two end walls thereof with outward projections.

3. A female socket of a connector as claimed in claim 1, wherein said metal shell is provided at said top wall thereof with at least one inward projection.

4. A female socket of a connector as claimed in claim 1, wherein said metal shell is provided at said top wall thereof with at least one inward projection.

5. A female socket of a connector as claimed in claim 1, wherein said metal shell is formed at one said end wall thereof with a backward-facing insertion opening, an elastic insert having a central through hole and a top cut being set in said insertion opening, whereby potions of said coaxial wires outside said socket base may be orderly laid in said central through hole of said insert via said top cut to extend out of said female socket in a direction normal to said female socket.

6. A female socket of a connector as claimed in claim 5, wherein said metal shell is provided near a rear portion of said top wall thereof with forward extended and downward inclined stopping plates, and front ends of said stopping plates abutting against a rear wall of said socket base.

7. A female socket of a connector as claimed in claim 5, wherein said metal shell is provided at said two end walls thereof with outward projections.

8. A female socket of a connector as claimed in claim 5, wherein said insertion opening on said metal shell is provided at upper and lower edges of a rear open end thereof with stoppers to prevent said insert from falling out of said insertion opening.

9. A female socket of a connector as claimed in claim 8, wherein said metal shell is provided near a rear portion of said top wall thereof with forward extended and downward inclined stopping plates, and front ends of said stopping plates abutting against a rear wall of said socket base.

* * * * *